United States Patent [19]

Staggs et al.

[11] Patent Number: 4,792,390

[45] Date of Patent: Dec. 20, 1988

[54] COMBINATION PROCESS FOR THE CONVERSION OF A DISTILLATE HYDROCARBON TO PRODUCE MIDDLE DISTILLATE PRODUCT

[75] Inventors: Darrell W. Staggs, Crystal Lake; Laurence O. Stine, Western Springs; Te-Yu M. Chen, Arlington Heights, all of Ill.

[73] Assignee: UOP Inc., Des Plaines, Ill.

[21] Appl. No.: 98,838

[22] Filed: Sep. 21, 1987

[51] Int. Cl.[4] ..... C10G 65/12; C10G 69/06

[52] U.S. Cl. ..... 208/50; 208/58; 208/61; 208/89

[58] Field of Search ..... 208/58, 57, 61, 50, 208/49, 89

[56] References Cited

U.S. PATENT DOCUMENTS

| | | | |
|---|---|---|---|
| 3,594,309 | 7/1971 | Stolfa | 208/89 |
| 3,730,875 | 5/1973 | Gleim et al. | 208/57 |
| 3,775,293 | 11/1973 | Watkins | 208/86 |
| 3,898,299 | 8/1975 | Jones | 260/683 R |
| 3,929,618 | 12/1975 | Abiko et al. | 208/73 |
| 3,944,481 | 3/1976 | Wing et al. | 208/61 |
| 3,984,305 | 10/1976 | Hosoi et al. | 208/57 |
| 4,137,147 | 1/1979 | Franck et al. | 208/61 |
| 4,181,601 | 1/1980 | Sze | 208/143 |
| 4,213,846 | 7/1980 | Sooter et al. | 208/50 |
| 4,235,703 | 11/1980 | Kegler et al. | 208/89 |
| 4,324,935 | 4/1982 | Wernicke et al. | 585/314 |
| 4,446,004 | 5/1984 | Chen et al. | 208/61 |
| 4,500,416 | 2/1985 | Van Dongen et al. | 208/89 |
| 4,626,340 | 12/1986 | Galiasso et al. | 208/89 |
| 4,661,238 | 4/1987 | Humbach et al. | 208/58 |
| 4,676,886 | 6/1987 | Rahbe et al. | 208/50 |

*Primary Examiner*—Anthony McFarlane

*Attorney, Agent, or Firm*—Thomas K. McBride; John G. Tolomei; John G. Cutts, Jr.

[57] ABSTRACT

A process for the conversion of an aromatic-rich, distillable gas oil charge stock which is essentially free from asphaltenic hydrocarbons and possesses an aromatic hydrocarbon concentration greater than about 20 volume percent to selectively produce large quantities of high quality middle distillate while minimizing hydrogen consumption which process comprises the steps of: (a) reacting the charge stock with hydrogen, in a catalytic hydrocracking reaction zone, at hydrocracking conditions including a maximum catalyst bed temperature in the range of about 600° F. (315° C.) to about 850° F. (454° C.) selected to convert at least a portion of the charge stock to lower-boiling hydrocarbon products including middle distillate and to convert at least 10 volume percent of the aromatic hydrocarbon compounds contained in the charge stock to provide an increased concentration of paraffin hydrocarbon compounds in the resulting hydrocracking reaction zone effluent; (b) separating the resulting hydrocracking reaction zone effluent to provide a middle distillate product stream and a paraffin-rich hydrocarbonaceous stream boiling at a temperature greater than about 700° F. (371° C.); (c) recovering the middle distillate product stream; (d) reacting the paraffin-rich hydrocarbonaceous stream recovered in step (b) in a thermal coking zone at mild thermal coking conditions including an elevated temperature from about 750° F. (399° C.) to about 950° F. (510° C.), a pressure from about 10 psig (69 kPa gauge) to about 150 psig (1034 kPa gauge) and a combined feed ratio from about 1 to about 2 to provide a thermal coking zone effluent; and (e) separating the thermal coking zone effluent to provide a fraction boiling in the range from about 300° F. (149° C.) to about 700° F. (371° C.).

27 Claims, 1 Drawing Sheet

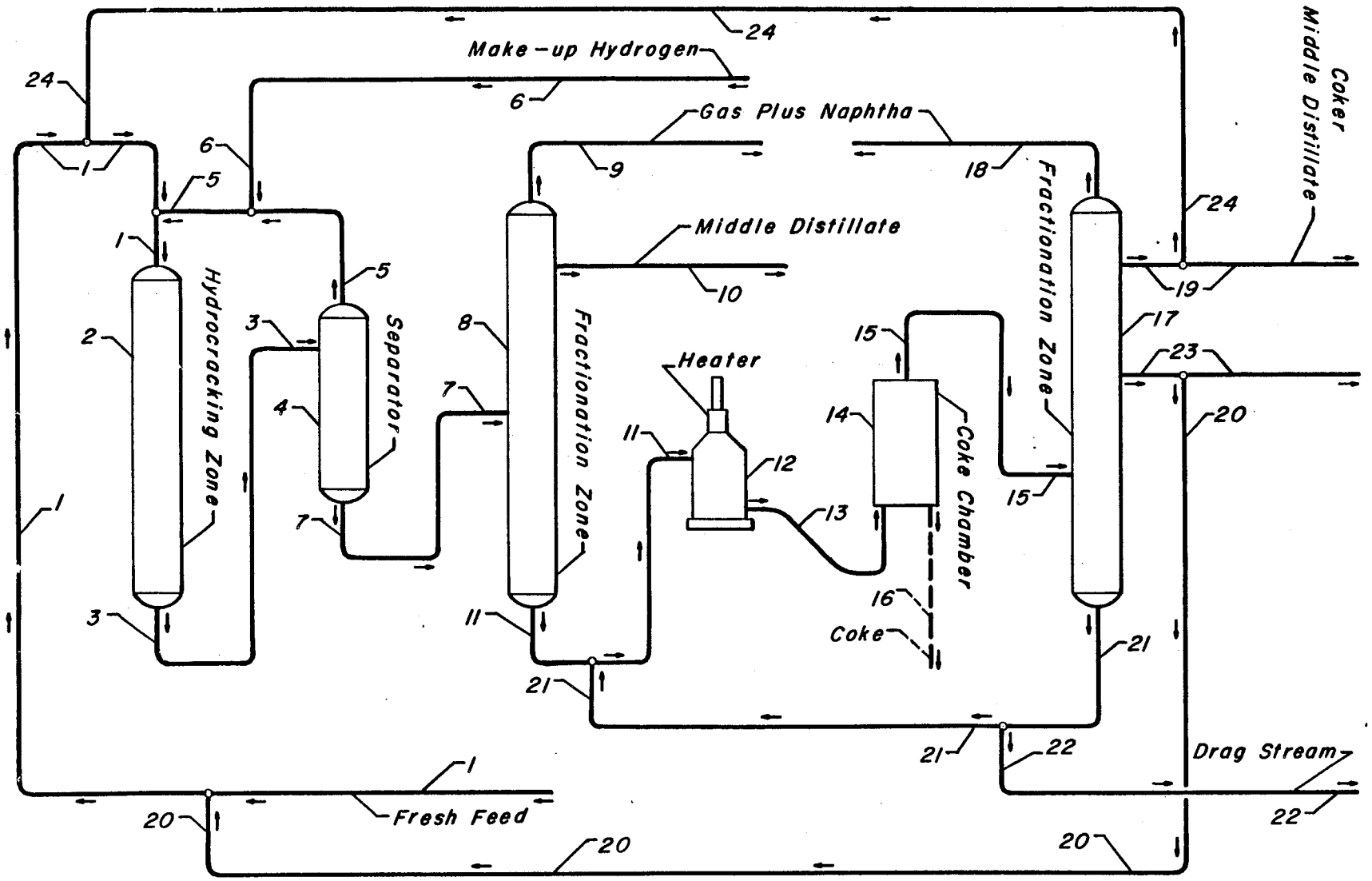
CASE 86A023

COMBINATION PROCESS FOR THE CONVERSION OF A DISTILLATE HYDROCARBON TO PRODUCE MIDDLE DISTILLATE PRODUCT

BACKGROUND OF THE INVENTION

The field of art to which this invention pertains is the maximization of middle distillate from heavy distillate hydrocarbon. More specifically, the invention relates to a process for the conversion of an aromatic-rich, distillable gas oil charge stock which is essentially free from asphaltenic hydrocarbons and possesses an aromatic hydrocarbon concentration greater than about 20 volume percent to selectively produce large quantities of high quality middle distillate while minimizing hydrogen consumption which process comprises the steps of: (a) reacting the charge stock with hydrogen, in a catalytic hydrocracking reaction zone, at hydrocracking conditions including a maximum catalyst bed temperature in the range of about 600° F. (315° C.) to about 850° F. (454° C.) selected to convert at least a portion of the charge stock to lower-boiling hydrocarbon products including middle distillate and to convert at least 10 volume percent of the aromatic hydrocarbon compounds contained in the charge stock to provide an increased concentration of paraffin hydrocarbon compounds in the resulting hydrocracking reaction zone effluent; (b) separating the resulting hydrocracking reaction zone effluent to provide a middle distillate product stream and a paraffin-rich hydrocarbonaceous stream boiling at a temperature greater than about 700° F. (371° C.); (c) recovering the middle distillate product stream; (d) reacting the paraffin-rich hydrocarbonaceous stream recovered in step (b) in a thermal coking zone at mild thermal coking conditions including an elevated temperature from about 750° F. (399° C.) to about 950° F. (510° C.), a pressure from about 10 psig (69 kPa gauge) to about 150 psig (1034 kPa gauge) and a combined feed ratio from about 1 to about 2 to provide a thermal coking zone effluent; and (e) separating the thermal coking zone effluent to provide a fraction boiling in the range from about 300° F. (149° C.) to about 700° F. (371° C.).

INFORMATION DISCLOSURE

In U.S. Pat. No. 3,730,875 (Gleim et al.), a process is disclosed for the conversion of an asphaltene-containing hydrocarbonaceous charge stock into lower-boiling hydrocarbon products which comprises (a) reacting said charge stock with hydrogen in a catalytic hydrogenation reaction zone; (b) further reacting the resulting hydrogenated effluent in a non-catalytic thermal reaction zone; and (c) reacting at least a portion of the resulting normally liquid, thermally-cracked effluent, in a catalytic hydrocracking reaction zone. The U.S. Pat. No. 3,730,875 also teaches that a portion of a hydrocracker effluent may be recycled to the hydrogenation zone.

In U.S. Pat. No. 3,594,309 (Stolfa), a process is disclosed for the conversion of an asphaltene-containing hydrocarbonaceous charge stock into lower-boiling hydrocarbon products which comprise (a) reacting said charge stock with hydrogen in a catalytic reaction zone, (b) cracking at least a portion of the catalytic reaction zone effluent in a non-catalytic reaction zone, and (c) recycling a slop wax stream resulting from the non-catalytic reaction zone to the catalytic reaction zone of step (a). The slop wax stream is characterized as boiling in a temperature range above that of the vacuum gas oils and within a temperature range of about 980° F. (526° C.) to about 1150° F. (620° C.).

In U.S. Pat. No. 3,775,293 (Watkins), a method is disclosed for reacting a hydrocarbonaceous resin with hydrogen, in a catalytic hydrocracking reaction zone, at hydrocracking conditions selected to convert resin into lower-boiling hydrocarbon; further reacting at least a portion of the hydrocracking effluent in a non-catalytic reaction zone, at thermal cracking conditions, and reacting at least a portion of the resulting thermally cracked product effluent in a separate catalytic reaction zone, with hydrogen, at hydrocracking conditions. Hydrocarbonaceous resins are considered to be non-distillable with boiling points greater than about 1050° F. (565° C.).

Furthermore, the hydrogenation of a thermal cracking feedstock is disclosed in U.S. Pat. Nos. 4,181,601 (Sze) and 4,324,935 (Wernicke et al.).

In U.S. Pat. No. 3,944,481 (Wing et al.), a process is disclosed for producing an ethylene-propylene product by hydrocracking a crude oil fraction containing asphaltenes and boiling in the range from 200° F. (93° C.) to 1000° F. (538° C.) at high severity conditions to produce a $C_2$–$C_5$ product in a yield of 91–95% and thermal cracking the resulting $C_2$–$C_5$ product to product ethylene and propylene. The U.S. Pat. No. 3,944,481 teaches that a suitable feedstock such as diesel fuel for example is converted at severe conditions to ensure that the hydrocarbon feed is completely converted to produce $C_2$–$C_5$ alkanes. The patentees desire a $C_2$–$C_5$ alkane product and do not suggest the conversion of an aromatic-rich, distillable gas oil charge stock which is essentially free from asphaltenic hydrocarbons and possesses an aromatic hydrocarbon concentration greater than about 20 volume percent into a maximum amount of middle distillate while minimizing hydrogen consumption.

In U.S. Pat. No. 3,898,299 (Jones), a process is disclosed for producing normally gaseous olefins by hydrogenating an atmospheric petroleum residue feedstock containing asphaltenes, separating the resulting hydrogenated feedstock into a distillate fraction boiling at a temperature less than 1200° F. (648° C.) and a residue fraction containing asphaltenes and thermal cracking the resulting distillate fraction to produce normally gaseous olefinic hydrocarbons such as ethylene and propylene. The patentee does not suggest a process wherein an aromatic-rich, distillable gas oil charge stock, which is asphalt-free by definition, is converted to selectively produce large quantities of high quality middle distillate, a normally-liquid hyrocarbon, while minimizing hydrogen consumption. The hydrogenation of an asphalt-containing hydrocarbon is well known to require large quantities of hydrogen.

In U.S. Pat. No. 3,984,305 (Hosoi et al.), a process is disclosed for producing a low sulfur content fuel oil in a high yield by means of a hydrogen treatment, a pyrolysis treatment and a desulfurizing treatment. The process of the U.S. Pat. No. 3,984,305 uses a non-distillable residual oil containing asphalt for a feedstock to produce a combustible low sulfur fuel oil and a substantial amount of high aromatic residue. The patentees do not suggest a process wherein an aromatic-rich, distillable gas oil charge stock, which is asphalt-free by definition, is converted to selectively produce large quantities of high quality middle distillate while minimizing hydrogen consumption.

In U.S. Pat. No. 4,235,703 (Kegler et al.), a process is disclosed for producing coke from residual oil wherein the residual oil is catalytically hydrotreated and subsequently coked.

In U.S. Pat. No. 4,213,846 (Sooter et al.), a process is disclosed for the coking of non-distillable hydrocarbonaceous feedstock and hydrotreating the resulting recycle gas oil before introduction into the coker.

BRIEF SUMMARY OF THE INVENTION

The invention provides an integrated process for the conversion of an aromatic-rich, distillable gas oil charge stock which is essentially free from asphaltenic hydrocarbons and possesses an aromatic hydrocarbon concentration greater than about 20 volume percent to selectively produce large quantities of high quality middle distillate while minimizing hydrogen consumption by reacting the aromatic-rich charge stock in a hydrocracking reaction zone to produce a middle distillate product stream and a paraffin-rich hydrocarbonaceous stream boiling at a temperature greater than about 700° F. This resulting paraffin-rich hydrocarbonaceous stream, which is particularly well suited for a charge stock for a thermal coking reaction by virtue of its high paraffin concentration and concomitant decreased aromatic content, is reacted in a thermal coking reaction zone at mild thermal coking conditions to produce another middle distillate product stream.

One embodiment of the invention may be characterized as a process for the conversion of an aromatic-rich, distillable gas oil charge stock which is essentially free from asphaltenic hydrocarbons and possesses an aromatic hydrocarbon concentration greater than about 20 volume percent to selectively produce large quantities of high quality middle distillate while minimizing hydrogen consumption which process comprises the steps of: (a) reacting the charge stock with hydrogen, in a catalytic hydrocracking reaction zone, at hydrocracking conditions including a maximum catalyst bed temperature in the range of about 600° F. (315° C.) to about 850° F. (454° C.) selected to convert at least a portion of the charge stock to lower-boiling hydrocarbon products including middle distillate and to convert at least 10 volume percent of the aromatic hydrocarbon compounds contained in the charge stock to provide an increased concentration of paraffin hydrocarbon compounds in the resulting hydrocracking reaction zone effluent; (b) separating the resulting hydrocracking reaction zone effluent to provide a middle distillate product stream and a paraffin-rich hydrocarbonaceous stream boiling at a temperature greater than about 700° F. (371° C.); (c) recovering the middle distillate product stream; (d) reacting the paraffin-rich hydrocarbonaceous stream recovered in step (b) in a thermal coking zone at mild thermal coking conditions including an elevated temperature from about 750° F. (399° C.) to about 950° F. (510° C.), a pressure from about 10 psig (69 kPa gauge) to about 150 psig (1034 kPa gauge) and a combined feed ratio from about 1 to about 2 to provide a thermal coking zone effluent; and (e) separating the thermal coking zone effluent to provide a fraction boiling in the range from about 300° F. (149° C.) to about 700° F. (371° C.).

Another embodiment of the invention may be characterized as a process for the conversion of an aromatic-rich, distillable gas oil charge stock which is essentially free from asphaltenic hydrocarbons and possesses an aromatic hydrocarbon concentration greater than about 20 volume percent to selectively produce large quantities of high quality middle distillate while minimizing hydrogen consumption which process comprises the steps of: (a) reacting the charge stock with hydrogen, in a catalytic hydrocracking reaction zone, at hydrocracking conditions including a maximum catalyst bed temperature in the range of about 600° F. (315° C.) to about 850° F. (454° C.) selected to convert at least a portion of the charge stock to lower-boiling hydrocarbon products including middle distillate and to convert at least 10 volume percent of the aromatic hydrocarbon compounds contained in the charge stock to provide an increased concentration of paraffin hydrocarbon compounds in the resulting hydrocracking reaction zone effluent; (b) separating the resulting hydrocracking reaction zone effluent to provide a first middle distillate product stream and a paraffin-rich hydrocarbonaceous stream boiling at a temperature greater than about 700° F. (371° C.); (c) reacting the paraffin-rich hydrocarbonaceous stream recovered in step (b) in a thermal coking zone at mild thermal coking conditions including an elevated temperature from about 750° F. (399° C.) to about 950° F. (510° C.), a pressure from about 10 psig (69 kPa gauge) to about 150 psig (1034 kPa gauge) and a combined feed ratio from about 1 to about 2 to provide a thermal coking zone effluent; (d) separating the thermal coking zone effluent to provide a second middle distillate product stream and a distillable hydrocarbonaceous stream boiling at a temperature greater than about 700° F. (371° C.); (e) recycling at least a portion of the distillable hydrocarbonaceous stream boiling at a temperature greater than about 700° F. (371° C.) recovered in step (d) to the catalytic hydrocracking reaction zone in step (a); and (f) recovering the first and second middle distillate product streams.

Other embodiments of the present invention encompass further details such as feedstock, hydrocracking catalysts, and operating conditions, all of which are hereinafter disclosed in the following discussion of each of these facets of the invention.

BRIEF DESCRIPTION OF THE DRAWING

The drawing is a simplified process flow diagram of a preferred embodiment of the present invention.

DETAILED DESCRIPTION OF THE INVENTION

There is a steadily increasing demand for high quality middle distillate products boiling in the range of about 300° F. (149° C.)–700° F. (371° C.). Such products include, for example, aviation turbine fuels, diesel fuels, heating oils, solvents and the like. In order to satisfy the demand for these products, a plethora of catalytic hydrocracking processes have been developed. However, catalytic hydrocracking has been previously aimed primarily at the production of lower boiling products such as gasoline and highly active catalysts have been developed for that purpose. These catalysts usually comprise a highly acidic cracking base such as hydrogen Y zeolite or silica-alumina cogel, upon which is deposited a suitable hydrogenation metal component. By utilizing these earlier catalysts and hydrocracking processes for the conversion of heavy oils boiling above about 700° F. (371° C.) to middle distillate products, the selectivity to middle distillate was much less than desirable. Under hydrocracking conditions which were severe enough to give economical conversion of the feedstock, a large proportion of the feedstock was converted to products boiling below about 400° F. (204° C.) thereby reducing the yield of middle distillate product. Enhanced yield of middle distillate product could be achieved, however, with improved middle distillate hydrocracking catalysts, but this method of conventional hydrocracking is expensive and, in many instances, uneconomical. For example, with a conventional hydrocracking process producing equivalent overall middle distillate yields relative to the process of the present invention, the advantages enjoyed by the present invention are (1) lower capital cost, (2) lower hydrogen consumption and (3) minimal loss of middle distillate in spite of the significantly lower hydrogen consumption.

The contemporary technology, as acknowledged hereinabove, teaches that asphaltene-containing hydrocarbonaceous charge stock and non-distillable hydrocarbonaceous charge stock boiling at a temperature greater than about 1050° F. (565° C.) may be charged to a hydrogenation or hydrocracking reaction zone and that at least a portion of the effluent from the hydrogenation or hydrocracking reaction zone may be charged to a non-catalytic thermal reaction zone or to a non-catalytic coking reaction zone. This technology has broadly taught the production of lower boiling hydrocarbons and coke. However, the present technology has not recognized that large quantities of high quality middle distillate may be produced with minimal hydrogen consumption by the conversion of an aromatic-rich, distillable gas oil charge stock which is essentially free from asphaltenic hydrocarbons and possesses an aromatic hydrocarbon concentration greater than about 20 volume percent in an integrated process.

With an increased demand for middle distillate product from heavy hydrocarbonaceous feedstock, more economical and selective processes for the conversion of heavy hydrocarbons have been sought. We have discovered, quite surprisingly, an integrated process which is highly selective towards the production of middle distillate with a charge stock of an asphaltene-free, aromatic-rich, distillable gas oil. The integrated process of the present invention has lower capital costs, improved selectivity to middle distillate product and reduced hydrogen consumption when compared with processes of the prior art.

The present invention provides an improved integrated process utilizing mild hydrocracking and thermal coking to produce significant quantities of middle distillate with low hydrogen consumption while simultaneously minimizing large yields of normally gaseous hydrocarbons, naphtha and coke. For purposes of the subject invention the term "middle distillate product" generally refers to a hydrocarbonaceous product which boils in the range of about 300° F. (149° C.) to about 700° F. (371° C.). The term "mild hydrocracking" is used to describe hydrocracking which is conducted at operating conditions which are generally less severe than those conditions used in conventional hydrocracking.

The hydrocarbon charge stock subject to processing in accordance with the process of the present invention is suitably an aromatic-rich, distillable petroleum fraction boiling in the range from about 700° F. (371° C.) to about 1100° F. (593° C.). For purposes of the present invention, the aromatic-rich, distillable hydrocarbon charge stock is essentially free from asphaltenic hydrocarbons. A preferred hydrocarbon charge stock boils in the range from about 700° F. (371° C.) to about 1050° F. (565° C.) and has an aromatic hydrocarbon compound concentration greater than about 20 volume percent. Petroleum hydrocarbon fractions which may be utilized as charge stocks thus include the heavy atmospheric and vacuum gas oils recovered as distillate in the atmospheric and vacuum distillation of crude oils. Also, heavy cycle oils recovered from the catalytic cracking process, and heavy coker gas oils resulting from low pressure coking may also be used as charge stocks. The hydrocarbon charge stock may boil substantially continuously between about 700° F. (371° C.) to about 1100° F. (593° C.) or it may consist of any one, or a number of petroleum hydrocarbon fractions, which distill over within the 700° F. (371° C.) to 1100° F. (593° C.) range. Suitable hydrocarbon charge stocks also include hydrocarbons derived from tar sand, oil shale and coal. Hydrocarbonaceous compounds boiling in the range from about 700° F. (371° C.) to about 1100° F. (593° C.) are herein referred to as gas oil. Although gas oils having an aromatic hydrocarbon compound concentration less than about 20 volume percent may be charged to the process of the subject invention, all of the herein-described advantages will not necessarily be fully enjoyed.

In the hydrocarbon processing art, an indicia of a hydrocarbon's characteristics has become well known and almost universally accepted and is referred to as the "UOP Characterization Factor" or "K". This UOP Characterization Factor is indicative of the general origin and nature of a hydrocarbon feedstock. "K" values of 12.5 or higher indicate a hydrocarbon material which is predominantly paraffinic in nature. Highly aromatic hydrocarbons have characterization factors of about 10.0 or less. The "UOP Characterization Factor", K, of a hydrocarbon is defined as the cube root of its absolute boiling point, in degrees Rankine, divided by its specific gravity at 60° F. Further information relating to the use of the UOP Characterization Factor may be found in a book entitled *The Chemistry and Technology of Petroleum,* published by Marcel Dekker, Inc., New York and Basel in 1980 at pages 46–47.

Preferred hydrocarbon feedstocks for use in the present invention preferably possess a UOP Characterization Factor, as hereinabove described, of less than about 12.4 and more preferably of less than about 12.0. Although feedstocks having a higher UOP Characterization Factor may be utilized as feedstock in the present invention, the use of such a feedstock may not necessarily enjoy all of the herein described benefits including the selective conversion to middle distillate product.

During the practice of the present invention while utilizing the hereinabove-described preferred hydrocarbonaceous feedstocks, it is contemplated that relatively small quantities of other potentially available hydrocarbonaceous materials, such as, for example, deasphalted oil and demetalized oil may be introduced into the process of the present invention as a commercial expediency. Although such hydrocarbonaceous materials are not preferred hydrocarbonaceous feedstocks of the present invention, those skilled in the art of hydrocarbon processing may find that the introduction of small quantities along with the preferred hydrocarbonaceous feedstock would not be unduly harmful and that some benefit may be enjoyed.

In accordance with the present invention an aromatic-rich, distillable gas oil charge stock is admixed with a recycled hydrogen-rich gaseous phase, make-up hydrogen and an optional recycled hydrocarbonaceous stream and introduced into a catalytic hydrocracking reaction zone. The optional recycled hydrocarbonaceous stream may, for example, boil in the range of about 300° F. (149° C.) to about 700° F. (371° C.) or in the range of about 700° F. (371° F.) to about 1000° F. (538° C.) or in the range of about 300° F. (149° C.) to about 1000° F. (538° C.). This reaction zone is preferably maintained under an imposed pressure of from about 500 psig (3447 kPa gauge) to about 3000 psig (20685 kPa gauge) and more preferably under a pressure from about 600 psig (4137 kPa gauge) to about 1600 psig (11032 kPa gauge). Suitably, such reaction is conducted with a maximum catalyst bed temperature in the range of about 600° F. (315° C.) to about 850° F. (454° C.) selected to convert at least a portion of the fresh feedstock to lower boiling hydrocarbon products and to convert at least about 10 volume percent of the aromatic hydrocarbon compounds contained in the charge stock to provide an increased concentration of paraffin hydrocarbon compounds in the resulting hydrocracking reaction zone effluent. In a preferred embodiment, the maximum catalyst bed temperature is selected to convert less than about 50 volume percent of the fresh charge stock to lower-boiling hydrocarbon products and to consume less than about 900 SCFB (160 std. $m^3/m^3$) of hydrogen based on fresh charge stock. Further operating conditions include liquid hourly space velocities in the range from about 0.2 $hour^{-1}$ to about 10 $hour^{-1}$ and hydrogen circulation rates from about 500 SCFB (88.9 std. $m^3/m^3$) to about 10,000 SCFB (1778 std. $m^3/m^3$), preferably from about 800 SCFB (142 std. $m^3/m^3$) to about 5,000 SCFB (889 std. $m^3/m^3$), while the combined feed ratio, defined as total volumes of liquid charge per volume of fresh hydrocarbon charge, is in the range from about 1:1 to about 3:1.

The catalytic composite disposed within the hydrocracking reaction zone can be characterized as containing a metallic component having hydrogenation activity, which component is combined with a suitable refractory inorganic oxide carrier material of either synthetic or natural origin. The precise composition and method of manufacturing the carrier material is not considered essential to the present invention. Preferred carrier material may, for example, comprise 100 weight percent alumina, 88 weight percent alumina and 12 weight percent silica, or 63 weight percent of alumina and 37 weight percent silica, or 68 weight percent alumina, 10 weight percent silica and 22 weight percent boron phosphate. Suitable metallic components having hydrogenation activity are those selected from the group consisting of the metals of Groups VI-B and VIII of the Periodic Table, as set forth in the *Periodic Table of the Elements*, E. H. Sargent and Company, 1964. Thus, the catalytic composites may comprise one or more metallic components from the group of molybdenum, tungsten, chromium, iron, cobalt, nickel, platinum, iridium, osmium, rhodium, ruthenium, and mixtures thereof. In addition, phosphorus is a suitable component of the catalytic composite which may be disposed within the hydrocracking reaction zone. The concentration of the catalytically active metallic component, or components, is primarily dependent upon a particular metal as well as the physical and/or chemical characteristics of the particular charge stock. For example, the metallic components of Group VI-B are generally present in an amount within the range of from about 1 to about 20 weight percent, the iron group metals in an amount within the range of about 0.2 to about 10 weight percent, whereas the noble metals of Group VIII are preferably present in an amount within the range of from about 0.1 to about 5 weight percent, all of which are calculated as if these components existed within the catalytic composite in the elemental state.

The resulting hydrocarbonaceous hydrocracking reaction zone effluent is separated to provide a paraffin-rich hydrocarbonaceous stream boiling at a temperature greater than about 700° F. (371° C.). Additionally, the resulting hydrocarbonaceous hydrocracking reaction zone effluent provides a middle distillate product stream which boils in the range of about 300° F. (149° C.) to about 700° F. (371° C.). The resulting paraffin-rich hydrocarbonaceous stream boiling at a temperature greater than about 700° F. (371° C.) is reacted in a non-catalytic coking reaction zone at thermal coking conditions including an elevated temperature in the range of about 750° F. (399° C.) to about 950° F. (510° C.), a pressure from about 10 psig (69 kPa gauge) to about 150 psig (1034 kPa gauge).

In accordance with the present invention, the non-catalytic coker is preferably operated at a relatively low severity in order to produce a maximum yield of hydrocarbonaceous products in the middle distillate boiling range. The resulting effluent from the non-catalytic coker reaction zone is preferably separated to provide a hydrocarbon stream boiling at less than about 300° F. (149° C.) comprising normally gaseous hydrocarbons and naphtha, a middle distillate hydrocarbon stream boiling in the range of about 300° F. (149° C.) to about 700° F. (371° C.) which may optionally be recycled to the hydrocracking reaction zone in admixture with the fresh feed and a hydrogen-rich gas, and a heavy hydrocarbonaceous product stream boiling in the range above that of middle distillate, viz., greater than about 700° F. (371° C.) which also may optionally be recycled to the hydrocracking reaction zone. Separation of the effluents from the coker reaction zone and the hydrocracking zone may be performed by any suitable and convenient means known to those skilled in the art. Such separation is preferably conducted in one or more fractional distillation columns, flash separators or combinations thereof.

In the drawing, one embodiment of the subject invention is illustrated by means of a simplified flow diagram in which such details as pumps, instrumentation, heat-exchange and heat-recovery circuits, compressors and similar hardware have been deleted as being non-essential to an understanding of the techniques involved. The use of such miscellaneous appurtenances are well within the purview of one skilled in the art of petroleum refining techniques. With reference now to the drawing, an asphaltene-free, aromatic-rich, distillable gas oil feedstock is introduced into the process via conduit 1, being admixed therein with a gaseous hydrogen-rich recycle stream which is provided via conduit 5 and hereinafter described hydrocarbonaceous recycle streams provided via conduit 20 and conduit 24. A hydrogen make-up stream is supplied to the process via conduit 6. Following suitable heat-exchange, the admixture continues through conduit 1 into hydrocracking zone 2 which contains a fixed bed of a catalytic composite of the type hereinabove described.

The principal function of hydrocracking zone 2 resides in the maximum production of middle distillate while minimizing the production of hydrocarbons boiling in the range below about 300° F. (149° C.) and in the conversion of aromatic hydrocarbon compounds contained in the charge stock to provide an increased concentration of paraffin hydrocarbon compounds. The peak temperature of the catalyst is adjusted to effect the desired yield pattern and aromatic hydrocarbon compound conversion. The effluent from hydrocracking zone 2 is cooled and passes via conduit 3 into separator 4. A hydrogen-rich gaseous stream is removed from separator 4 via conduit 5 and recycled to hydrocracking zone 2 via conduits 5 and 1. Since hydrogen is consumed within the hydrocracking process, it is necessary to supplant the consumed hydrogen with make-up hydrogen from some suitable external source, i.e., a catalytic reforming unit or a hydrogen plant. Make-up hydrogen may be introduced into the system at any suitable point such as, for example, by means of conduit 6. The normally liquid hydrocarbons are removed from separator 4 via conduit 7 and introduced into fractionation zone 8. A middle distillate hydrocarbonaceous product is removed from fractionation zone 8 via conduit 10 and a paraffin-rich hydrocarbonaceous stream boiling in a range above the middle distillate boiling range is removed from fractionation zone 8 via conduit 11. A light hydrocarbonaceous product stream boiling at a temperature less than about 350° F. (177° C.) is removed from fractionation zone 8 via conduit 9. The paraffin-rich hydrocarbonaceous stream boiling in a range above that of middle distillate is introduced via conduit 11 into coker heater 12, wherein the hydrocarbonaceous stream is heated to coking conditions including an elevated temperature in the range of about 700° F. (371° C.) to about 980° F. (526° C.). The resulting heated paraffin-rich hydrocarbonaceous stream is introduced via conduit 13 into coke chamber 14 where the hydrocarbonaceous stream is thermally converted to produce coke and vaporous coker products which are removed from coke chamber 14 via conduit 15 and introduced into fractionation zone 17. The resulting coke which is deposited in coke chamber 14 is occasionally removed via conduit 16 utilizing well known coke cutting and removal techniques. A hydrocarbonaceous stream boiling in the range from about 350° F. (177° C.) to about 700° F. (371° C.) is withdrawn from fractionation zone 17 via conduit 19 and at least a portion is introduced into hydrocracking zone 2 via conduits 24 and 1 as a hereinabove-mentioned hydrocarbonaceous recycle stream. Such a product stream produced in a thermal coking zone will necessarily be olefinic in nature and may require further processing if not recycled to the hydrocracking zone. A light hydrocarbon stream boiling in the range below that of middle distillate is removed from fractionation zone 17 via conduit 18 and recovered. A heavy distillable hydrocarbon stream boiling in the range above that of middle distillate is removed from fractionation zone 17 via conduit 23 and at least a portion is recycled to hydrocracking zone 2 via conduits 23, 20 and 1 as a hereinabove-mentioned hydrocarbonaceous recycle stream. A heavy bottoms fraction is removed from fractionation zone 17 and is recycled to coker heater 14 via conduits 21 and 11. A bottoms drag stream is also recovered from fractionation zone 17 via conduits 21 and 22.

The following illustrative embodiments are presented for the purpose of further demonstrating the process of the present invention and to indicate the benefits afforded without undue limitation by the utilization thereof in maximizing the yield of middle distillate from heavy distillate hydrocarbons. The following data were not obtained by the actual performance of the present invention, but are considered prospective and reasonably illustrative of the expected performance of the invention.

ILLUSTRATIVE EMBODIMENT 1

An asphaltene-free, aromatic-rich distillable feedstock having the characteristics presented in Table 1 is charged at a rate of 100 grams per hour to a hydrocracking reaction zone loaded with a catalyst comprising silica, alumina, nickel and molybdenum.

TABLE 1

| Feedstock Properties | |
|---|---|
| Boiling Range, °F.(°C.) | 700(371)–986(529) |
| Gravity, °API (Specific) | 24.1(0.909) |
| Sulfur, weight % | 2.6 |
| Nitrogen, weight % | 0.06 |
| Carbon residue, weight % | 0.1 |
| UOP K | 11.78 |
| Aromatics, Volume % | 55 |

The reaction is performed with a catalyst peak temperature of 750° F. (399° C.), a pressure of 680 psig (4688 kPa gauge), a liquid hourly space velocity of 2.06 based on fresh feed and a hydrogen circulation rate of 2500 SCFB (445 std. $m^3/m^3$). The effluent from the hydrocracking zone is cooled to about 100° F. (38° C.) and sent to a vapor-liquid separator wherein a gaseous hydrogen-rich stream is separated from the normally liquid hydrocarbons. The resulting gaseous hydrogen-rich stream is then recycled to the hydrocracking zone together with a fresh supply of hydrogen in an amount sufficient to maintain the hydrocracking zone pressure. The normally liquid hydrocarbons are removed from the separator and charged to a fractionation zone. The fractionation zone produces a light hydrocarbon product stream boiling at a temperature less than 350° F. (177° C.) in an amount of 4.6 grams per hour, a middle distillate product stream in an amount of 23.2 grams per hour and having the properties presented in Table 2 and a heavy paraffin-rich hydrocarbonaceous stream boiling at a temperature greater than 700° F. (371° C.), having a UOP K of 11.90 and containing 45 volume percent aromatic hydrocarbons in an amount of 72.8 grams per hour. About 40 volume percent of the aromatic hydrocarbon compounds contained in the feedstock is converted to increase the concentration of non-aromatic hydrocarbon compounds including paraffin hydrocarbon compounds.

TABLE 2

| Hydrocracker Middle Distillate Product Properties | |
|---|---|
| Boiling range, °F.,(°C.) | 350(177)–700(371) |
| Gravity, °API (specific) | 31.8(.866) |
| Cetane Index | 44.8 |

The resulting paraffin-rich heavy hydrocarbonaceous stream is then charged to a coking zone maintained at a pressure of about 20 psig (138 kPa gauge) and a temperature of about 810° F. (432° C.).

The effluent from the coking zone is introduced into a second fractionation zone which produced a light hydrocarbon product stream boiling at a temperature less than 350° F. (177° C.) in an amount of 26 grams per hour, a middle distillate hydrocarbon stream boiling in the range from about 350° F. (177° C.) to about 700° F. (371° C.) in an amount of 38.8 grams per hour and a coker gas oil stream in the amount of 1.5 grams per hour and having the properties presented in Table 3. The product properties of the middle distillate hydrocarbon stream recovered from the coking zone effluent are presented in Table 4 and were approximately the same as those for the middle distillate recovered from the hydrocracking zone and presented in Table 2 with the exception that the coking zone middle distillate was olefinic, as indicated by the bromine number, as a result of the coking processing. In some cases, this olefinic characteristic may be somewhat undesirable for certain applications and therefore it may be desirable to hydrogenate the resulting coking zone middle distillate in order to reduce the level of olefinicity.

TABLE 3

Coking Zone Gas Oil Product Properties

| | Illustrative Embodiment 1 | Illustrative Embodiment 2 |
|---|---|---|
| Boiling range, °F.(°C.) | 700+(371+) | 700(371+) |
| Gravity, °API (Specific) | 25.7(0.900) | 26.3(.897) |
| Sulfur, weight % | 0.5 | 0.4 |
| Carbon residue, weight % | 0.1 | 0.1 |
| UOP K | 11.72 | 11.76 |

TABLE 4

Coking Zone Middle Distillate Product Properties

| | |
|---|---|
| Boiling range, °F.(°C.) | 350(177)-700(371) |
| Gravity, °API (Specific) | 34.6(0.852) |
| Bromine Number | 20 |
| Cetane Index | 48.4 |

In summary, one embodiment of the process of the present invention produced the following products based on the weight of the fresh fed distillate; light hydrocarbons boiling below about 350° F. (177° C.), 30.6 weight percent; middle distillate product (from hydrocracker and coking zone) having a boiling range from about 350° F. (177° C.), to about 700° F. (371° C.), 62 weight percent, a coker gas oil stream, 1.5 weight percent; and coke, 6.5 weight percent. In addition, it should be noted by a comparison of Tables 1 and 3 that the coker zone gas oil product possesses superior physical characteristics in contrast with the original feedstock. In accordance with the objective of the present invention, an outstanding amount of middle distillate, 62 weight percent based on fresh feed, is surprisingly and unexpectedly produced.

ILLUSTRATIVE EMBODIMENT 2

In this Illustrative Embodiment all of the middle distillate is recovered from the effluent of the hydrocracking zone. An aromatic-rich, distillable feedstock having the characteristics presented in Table 1 hereinabove is charged at a rate of 100 g/hr to a hydrocracking reaction zone loaded with the catalyst of Illustrative Embodiment 1 comprising silica, alumina, nickel and molybdenum. The reaction is performed with a catalyst peak temperature of 750° F. (399° C.), a pressure of 680 psig (4688 kPa gauge), a liquid hourly space velocity of 1.05 based on fresh feed and a hydrogen circulation rate of 2500 SCFB (444 std. $m^3/m^3$). In addition, two recycle streams, more fully described hereinbelow, are charged to the hydrocracking zone at a rate of 36.6 g/hr of light coker gas oil and 56.4 g/hr of heavy coker gas oil. The effluent from the hydrocracking zone is cooled to about 100° F. (38° C.) and sent to a vapor-liquid separator wherein a gaseous hydrogen-rich stream is separated from the normally liquid hydrocarbons. The resulting gaseous hydrogen-rich stream is then recycled to the hydrocracking zone together with a fresh supply of hydrogen in an amount sufficient to maintain the hydrocracking zone pressure. The normally liquid hydrocarbons are removed from the separator and charged to a fractionation zone. The fractionation zone produces a light hydrocarbon product stream boiling at a temperature less than 350° F. (177° C.) in an amount of 5.6 g/hr, a middle distillate product stream in an amount of 68.8 g/hr and having the properties presented in Table 5 and a paraffin-rich, heavy hydrocarbonaceous stream boiling at a temperature greater than 700° F. (371° C.), having a UOP K of 11.94 and containing 45 volume percent aromatic hydrocarbons in an amount of 119.4 g/hr. About 40 volume percent of the aromatic hydrocarbon compounds contained in the feedstock was converted to increase the concentration of paraffin hydrocarbon compounds.

For purposes of comparison, the blended composite of hydrocracker and coker middle distillate product from Illustrative Embodiment 1 is analyzed and is found to have the properties presented in Table 5.

TABLE 5

Middle Distillate Product Properties

| | Illustrative Embodiment 2 | Illustrative Embodiment 1 Blend |
|---|---|---|
| Boiling range, °F.(°C.) | 350(177)-700(371) | 350(177)-700(371) |
| Graviiy, °API (Specific) | 34.6(0.852) | 33.5(0.857) |
| Cetane Number | 48.1 | 46.8 |
| Bromine Number | <2 | 17 |

The resulting paraffin-rich heavy hydrocarbonaceous stream is then charged to a thermal coking zone maintained at a pressure of about 20 psig (137.9 kPa gauge) and a temperature of about 810° F. (432° C.).

The hydrocarbonaceous effluent from the thermal coking zone is introduced into a second fractionation zone which produces a light hydrocarbon product stream boiling at a temperature less than 350° F. (177° C.) in an amount of 17.3 g/hr, a middle distillate hydrocarbon stream boiling in the range from about 350° F. (177° C.) to about 700° F. (371° C.) which is recycled to the hydrocracking zone in an amount of 36.6 g/hr and a coking zone gas oil product in the amount of 58.7 g/hr and having the properties presented in Table 3 hereinabove; 56.4 g/hr of which is recycled to the hydrocracking zone and 2.3 g/hr is taken as a net product.

In summary, one embodiment of the present invention produces the following products based on the weight of the fresh feed distillate; light hydrocarbons boiling below about 350° F. (177° C.), 22.9 weight percent; middle distillate product having a boiling range from about 350° F. (177° C.) to about 700° F. (371° C.), 68.8 weight percent; coking zone gas oil product, 2.3 weight percent and coke, 6.8 weight percent. In addition, it should be noted by a comparison of Tables 1 and 3 that the thermal coking zone gas oil product possesses superior physical characteristics in contrast with the feedstock such as, for example, the thermal coking zone gas oil product has a lower specific gravity, a lower sulfur and nitrogen content. The utilization of this embodiment of the present invention produces 68.8 weight percent middle distillate, based on fresh feed, and as a result of recycling the thermal coking zone middle distillate to the hydrocracker zone, the quality of the overall middle distillate product in terms of bromine number and cetane index is improved while not significantly affecting the specific gravity. This improvement is demonstrated by the comparison of middle distillate product properties presented in Table 5.

The foregoing description, drawing and illustrative embodiments clearly illustrate the advantages encompassed by the process of the present invention and the benefits to be afforded with the use thereof.

We claim as our invention:

1. A process for the conversion of an aromatic-rich, distillable gas oil charge stock which is essentially free from asphaltenic hydrocarbons and possesses an aromatic hydrocarbon concentration greater than about 20 volume percent to selectively produce large quantities of high quality middle distillate while minimizing hydrogen consumption which process comprises the steps of:

(a) reacting said charge stock with hydrogen, in a catalytic hydrocracking reaction zone, at hydrocracking conditions including a maximum catalyst bed temperature in the range of about 600° F. (315° C.) to about 850° F. (454° C.) selected to convert at least a portion of said charge stock to lower-boiling hydrocarbon products including middle distillate and to convert at least 10 volume percent of the aromatic hydrocarbon compounds contained in said charge stock to provide an increased concentration of paraffin hydrocarbon compounds in the resulting hydrocracking reaction zone effluent;

(b) separating said resulting hydrocracking reaction zone effluent to provide a middle distillate product stream and a paraffin-rich hydrocarbonaceous stream boiling at a temperature greater than about 700° F. (371° C.);

(c) recovering said middle distillate product stream;

(d) reacting said paraffin-rich hydrocarbonaceous stream recovered in step (b) in a thermal coking zone at mild thermal coking conditions including an elevated temperature from about 750° F. (399° C.) to about 950° F. (510° C.), a pressure from about 10 psig (69 kPa gauge) to about 150 psig (1034 kPa gauge) and a combined feed ratio from about 1 to about 2 to provide a thermal coking zone effluent wherein said combined feed ratio is defined as total valume of liquid charged per volume of fresh hydrocarbon charge;

(e) separating said thermal coking zone effluent to provide a fraction boiling in the range from about 300° F. (149° C.) to about 700° F. (371° C.) and a distillable hydrocarbonaceous stream boiling in the range from about 700° F. (371° C.) to about 1000° F. (538° C.); and (f) recycling at least a portion of said distillable hydrocarbonaceous stream boiling in the range from about 700° F. (371° C.) to about 1000° F. (538° C.) recovered in step (e) to said catalytic hydrocracking reaction zone in step (a).

2. The process of claim 1 wherein at least a portion of the thermal coking zone effluent boiling in the range from about 300° F. (149° C.) to about 700° F. (371° C.) is recycled to said catalytic hydrocracking reaction zone of step (a).

3. The process of claim 1 wherein said aromatic-rich, distillable gas oil charge stock boils in the range from about 700° F. (371° C.) to about 1050° F. (565° C.).

4. The process of claim 1 wherein said aromatic-rich, distillable gas oil charge stock possesses a UOP Characterization Factor less than about 12.4.

5. The process of claim 1 wherein said hydrocracking conditions include a pressure from about 500 psig (3447 kPa gauge) to about 3000 psig (20685 kPa gauge).

6. The process of claim 1 wherein said hydrocracking conditions include a pressure from about 600 psig (4137 kPa gauge) to about 1600 psig (11032 kPa gauge).

7. The process of claim 1 wherein said hydrocracking conditions include a liquid hourly space velocity from about 0.2 to about 10.0 $hr.^{-1}$ based on fresh feed.

8. The process of claim 1 wherein said hydrocracking conditions include a hydrogen circulation rate of about 500 SCFB (88.9 std. $m^3/m^3$) to about 10,000 SCFB (1778 std. $m^3/m^3$).

9. The process of claim 1 wherein said catalytic hydrocracking reaction zone is operated at conditions selected to convert less than about 50 volume percent of said charge stock to lower-boiling hydrocarbon product.

10. The process of claim 1 wherein said thermal coking conditions include a pressure from about 10 psig (69 kPa gauge) to about 100 psig (689 kPa gauge).

11. The process of claim 1 wherein said catalytic hydrocracking reaction zone contains a catalyst comprising a refractory inorganic oxide and at least one metal component selected from Groups VIB and VIII.

12. The process of claim 1 wherein said catalytic hydrocracking reaction zone contains a catalyst comprising silica, alumina, nickel and molybdenum.

13. The process of claim 1 wherein said catalytic hydrocracking reaction zone contains a catalyst comprising silica, alumina, cobalt and molybdenum.

14. The process of claim 1 wherein the hydrogen consumption in said catalytic hydrocracking reaction zone of step (a) is less than about 900 SCFB (160 std. $m^3/m^3$) based on fresh charge stock.

15. The process of claim 1 wherein at least a portion of said fraction boiling in the range from about 300° F. (149° C.) to about 700° F. (371° C.) provided in step (e) is recovered to provide a middle distillate product stream.

16. A process for the conversion of an aromatic-rich, distillable gas oil charge stock which is essentially free from asphaltenic hydrocarbons and possesses an aromatic hydrocarbon concentration greater than about 20 volume percent to selectively produce large quantities of high quality middle distillate while minimizing hydrogen consumption which process comprises the steps of:

(a) reacting said charge stock with hydrogen, in a catalytic hydrocracking reaction zone, at hydrocracking conditions including a maximum catalyst bed temperature in the range of about 600° F. (315° C.) to about 850° F. (454° C.) selected to convert at least a portion of said charge stock to lower-boiling hydrocarbon products including middle distillate and to convert at least 10 volume percent of the aromatic hydrocarbon compounds contained in said charge stock to provide an increased concentration of paraffin hydrocarbon compounds in the resulting hydrocracking reaction zone effluent;

(b) separating said resulting hydrocracking reaction zone effluent to provide a first middle distillate product stream and a paraffin-rich hydrocarbonaceous stream boiling at a temperature greater than about 700° F. (371° C.);

(c) reacting said paraffin-rich hydrocarbonaceous stream recovered in step (b) in a thermal coking zone at mild thermal coking conditions including an elevated temperature from about 750° F. (399° C.) to about 950° F. (510° C.), a pressure from about 10 psig (69 kPa gauge) to about 150 psig (1034 kPa gauge) and a combined feed ratio from about 1 to about 2 to provide a thermal coking zone effluent wherein said combined feed ratio is defined as total volume of liquid charge per volume of fresh hydrocarbon charge;

(d) separating said thermal coking zone effluent to provide a second middle distillate product stream and a distillable hydrocarbonaceous stream boiling at a temperature greater than about 700° F. (371° C.);

(e) recycling at least a portion of said distillable hydrocarbonaceous stream boiling at a temperature in the range of about 700° F. (371° C.) to about 1050° F. (565° C.) recovered in step (d) to said catalytic hydrocracking reaction zone in step (a); and (f) recovering said first and second middle distillate product streams.

17. The process of claim 16 wherein said aromatic-rich, distillable gas oil charge stock possesses a UOP Characterization Factor less than about 12.4.

18. The process of claim 16 wherein said hydrocracking conditions include a pressure from about 500 psig (3447 kPa gauge) to about 3000 psig (20685 kPa gauge).

19. The process of claim 16 wherein said hydrocracking conditions include a pressure from about 600 psig (4137 kPa gauge) to about 1600 psig (11032 kPa gauge).

20. The process of claim 16 wherein said hydrocracking conditions include a liquid hourly space velocity from about 0.2 to about 10.0 $hr.^{-1}$ based on fresh feed.

21. The process of claim 16 wherein said hydrocracking conditions include a hydrogen circulation rate of about 500 SCFB (88.9 std. $m^3/m^3$) to about 10,000 SCFB (1778 std. $m^3/m^3$).

22. The process of claim 16 wherein said catalytic hydrocracking reaction zone is operated at conditions selected to convert less than about 50 volume percent of said charge stock to lower-boiling hydrocarbon product.

23. The process of claim 16 wherein said thermal coking conditions include a pressure from about 10 psig (69 kPa gauge) to about 100 psig (689 kPa gauge).

24. The process of claim 16 wherein said catalytic hydrocracking reaction zone contains a catalyst comprising a refractory inorganic oxide and at least one metal component selected from Groups VIB and VIII.

25. The process of claim 16 wherein said catalytic hydrocracking reaction zone contains a catalyst comprising silica, alumina, nickel and molybdenum.

26. The process of claim 16 wherein said catalytic hydrocracking reaction zone contains a catalyst comprising silica, alumina, cobalt and molybdenum.

27. The process of claim 16 wherein the hydrogen consumption in said catalytic hydrocracking reaction zone of step (a) is less than about 900 SCFB (160 std. $m^3/m^3$) based on fresh charge stock.

* * * * *